United States Patent [19]

de Muro et al.

[11] Patent Number: 4,879,533

[45] Date of Patent: Nov. 7, 1989

[54] SURFACE MOUNT FILTER WITH INTEGRAL TRANSMISSION LINE CONNECTION

[75] Inventors: David M. de Muro; John G. Stillmank, both of Schaumburg; Duane C. Rabe, Rolling Meadows, all of Ill.

[73] Assignee: Motorola, Inc., Schaumburg, Ill.

[21] Appl. No.: 176,541

[22] Filed: Apr. 1, 1988

[51] Int. Cl.[4] ..... H01P 1/202; H01P 7/04

[52] U.S. Cl. ..... 333/206; 333/202; 333/222

[58] Field of Search ..... 333/202–207, 333/246, 222, 219, 219.1, 238; 455/78; 370/30, 36, 38

[56] References Cited

U.S. PATENT DOCUMENTS

| | | | |
|---|---|---|---|
| 3,293,644 | 12/1966 | Loos et al. | 370/38 |
| 3,506,932 | 4/1970 | Beurrier | 333/116 |
| 3,573,670 | 4/1971 | Skobern | 333/33 |
| 3,728,731 | 4/1973 | Choi et al. | 370/40 |
| 4,080,601 | 3/1978 | Alcorn, Jr. | 370/38 |
| 4,110,715 | 8/1978 | Reindel | 333/204 |
| 4,186,359 | 1/1980 | Kaegebein | 333/134 |
| 4,211,987 | 7/1980 | Pan | 333/230 |
| 4,268,809 | 5/1981 | Makimoto et al. | 333/202 |
| 4,276,525 | 6/1981 | Nishikawa et al. | 333/206 |
| 4,342,972 | 8/1982 | Nishikawa et al. | 333/206 |
| 4,386,328 | 5/1983 | Masuda et al. | 333/202 |
| 4,425,555 | 1/1984 | Meguro et al. | 333/202 |
| 4,426,631 | 1/1984 | D'Avello et al. | 333/202 |
| 4,429,289 | 1/1984 | Higgins, Jr. et al. | 333/204 |
| 4,431,977 | 2/1984 | Sokola et al. | 333/206 |
| 4,462,098 | 7/1984 | D'Avello et al. | 370/30 |
| 4,546,333 | 10/1985 | Fukasawa et al. | 333/202 |
| 4,673,902 | 6/1987 | Takeda et al. | 333/202 |
| 4,692,726 | 9/1987 | Green et al. | 333/206 |
| 4,703,291 | 10/1987 | Nishikawa et al. | 333/202 |

FOREIGN PATENT DOCUMENTS

| | | | |
|---|---|---|---|
| 0065601 | 4/1985 | Japan | 333/202 |
| 0254802 | 12/1985 | Japan . | |
| 0023204 | 1/1987 | Japan | 333/202 |
| 2165098 | 4/1986 | United Kingdom . | |

OTHER PUBLICATIONS

Hano et al. "A Bandpass Filter Using Direct-Coupled Quarter Wavelength Coaxial Dielectric Resonators"; Microwave Journal, Nov. 1987, pp. 141–160.

*Primary Examiner*—Eugene R. LaRoche
*Assistant Examiner*—Seung Ham
*Attorney, Agent, or Firm*—Raymond A. Jenski; Rolland R. Hackbart

[57] ABSTRACT

A surface mount dielectric block filter with an integral transmission line connection to external circuitry is disclosed. In order to connect an input/output capacitor metallized on the surface of the dielectric block to a substrate upon which the dielectric block is directly mounted, a transmission line of appropriate characteristic impedance disposed on the surface of the dielectric block is connected between one plate of the metallized capacitor and an input/output terminal. Two such dielectric block filters may be coupled together to form a radio transceiver duplexer.

45 Claims, 5 Drawing Sheets

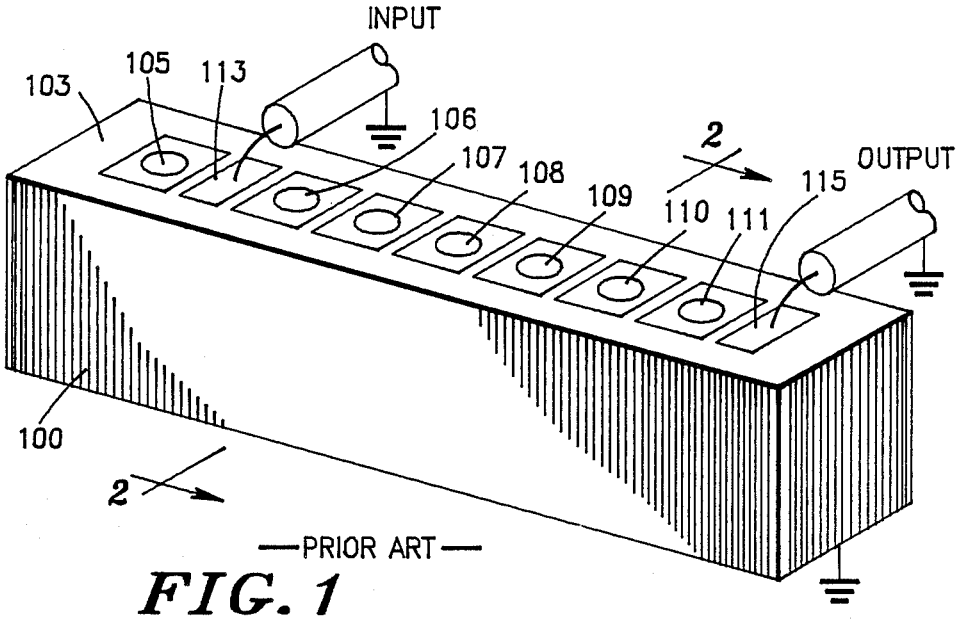
—PRIOR ART—
FIG. 1
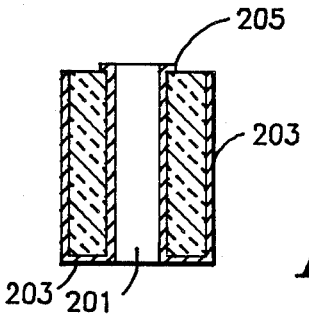
—PRIOR ART—
FIG. 2
FIG. 3
—PRIOR ART—
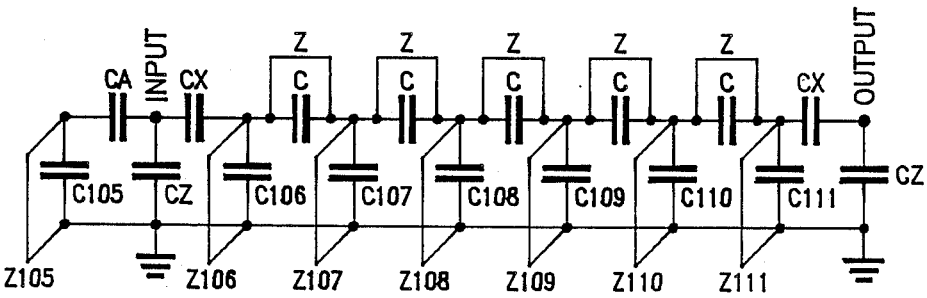

FIG. 4A
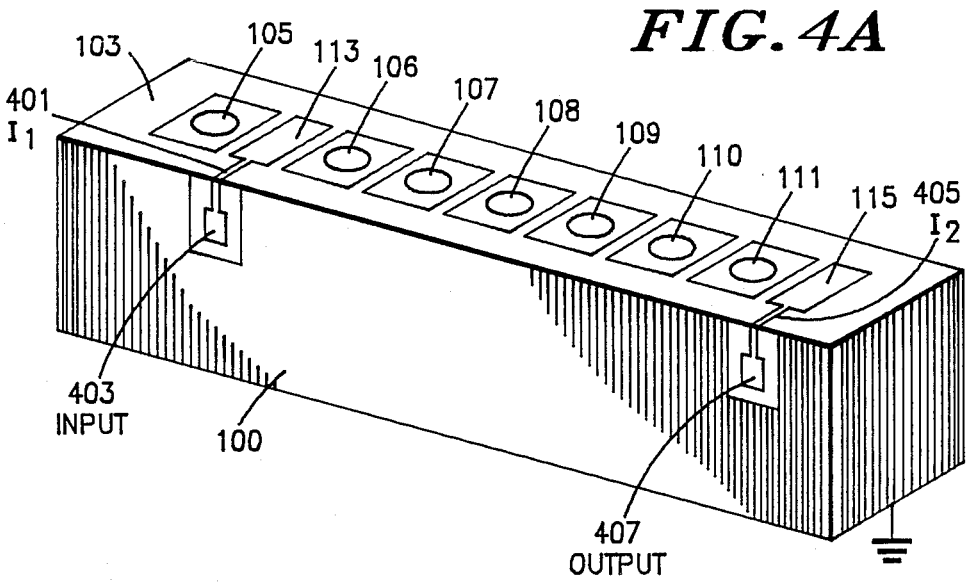
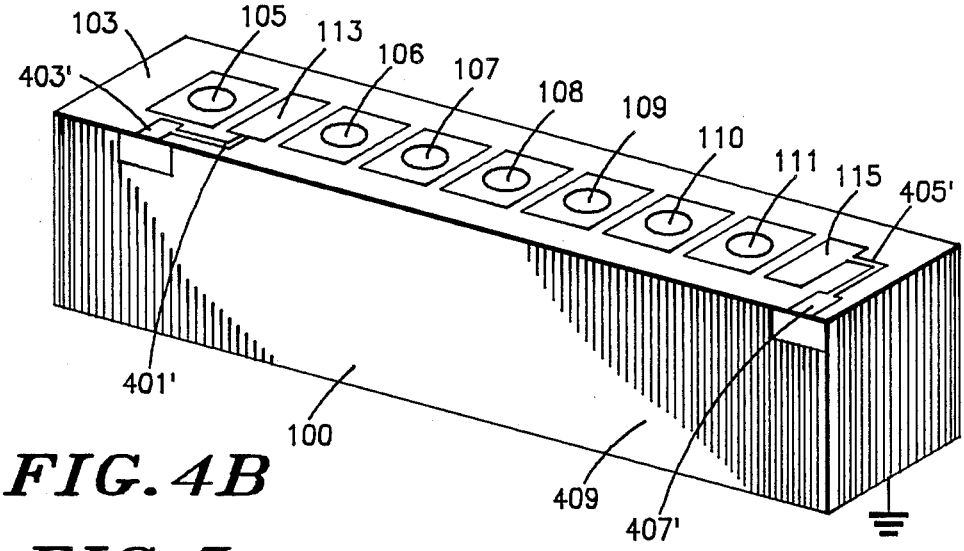
FIG. 4B
FIG. 5
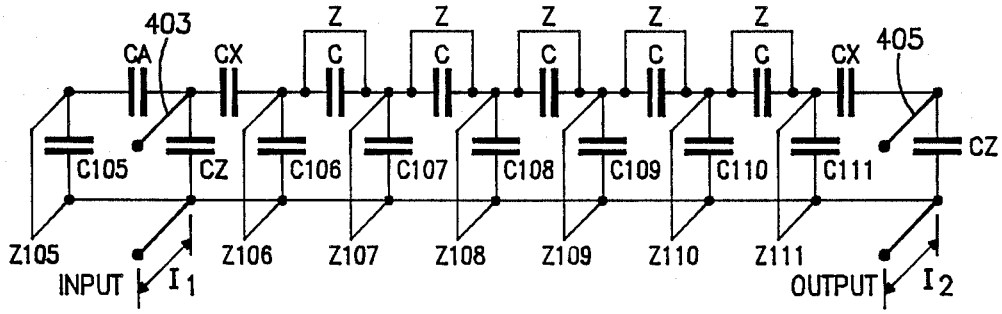

FIG. 4C
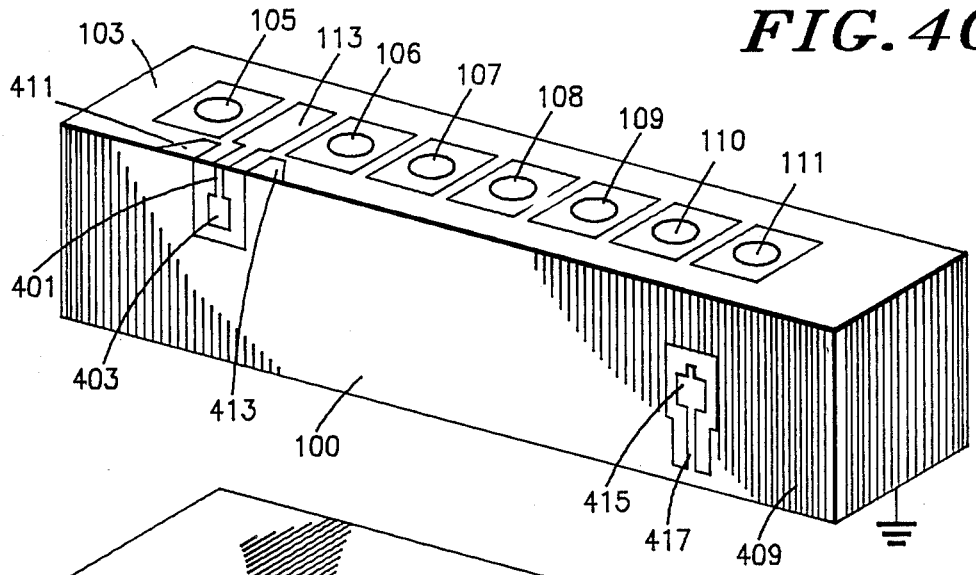
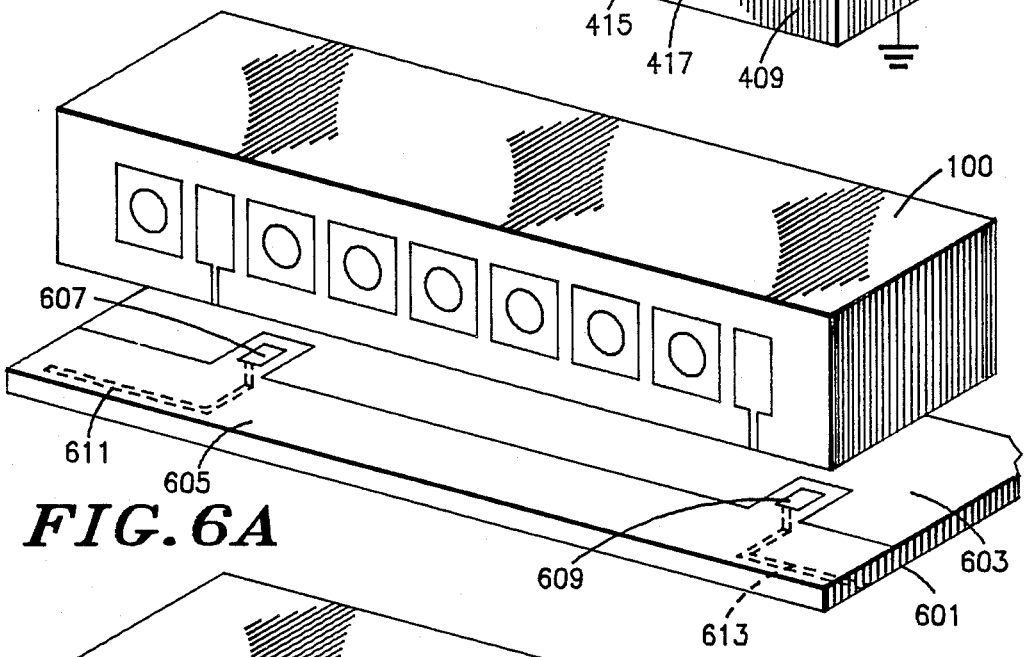
FIG. 6A
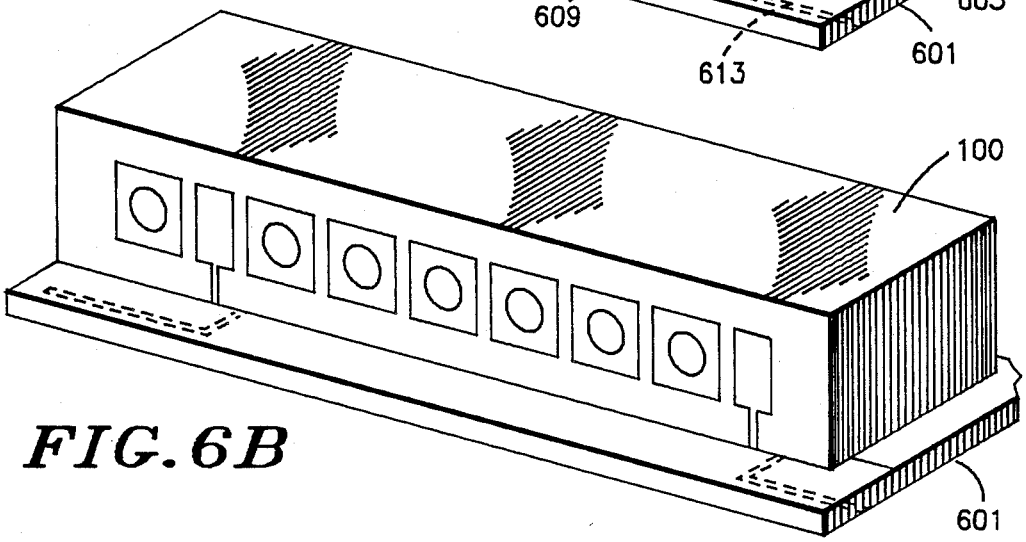
FIG. 6B

SURFACE MOUNT FILTER WITH INTEGRAL TRANSMISSION LINE CONNECTION

BACKGROUND OF THE INVENTION

This invention relates generally to surface mount filters and more particularly to a surface mount dielectric filter which employs a transmission line disposed on a surface of the dielectric filter in order to achieve improved matching and external interconnection.

The reduced size of mobile and portable radio transceivers have placed increased requirements on the filters employed in providing radio frequency (RF) filtering within the transceivers. To enable further size reduction of such filters (which may be used for receiver preselector functions, transmitter harmonic filters, duplexers, and interstage coupling), the coupling of the filter to external circuitry has been achieved by directly connecting one of the plates of an integral coupling capacitor to a mounting substrate, such as has been shown in U.S. Pat. No. 4,673,902 (Takeda, et al.). In some critical applications, however, placing the coupling capacitor plate close to the edge of the filter creates a variability in the value of capacitance due to the proximity of the substrate (which has a dielectric constant greater than free space) and due to the effects of soldering the capacitor plate to the substrate. Furthermore, if the plate of the capacitor is elongated for any significant portion of a wavelength of the frequencies of interest, the plate develops undesirable capacity to ground which adversely affects the coupling to the resonator.

SUMMARY OF THE INVENTION

It is, therefore, one object of the present invention to enable the direct surface mounting of a dielectric filter to a mounting substrate without direct connection of a coupling capacitor plate to the substrate.

It is another object of the present invention to utilize an integral transmission line of known characteristic impedance to interconnect the coupling capacitor to external circuitry.

It is a further object of the present invention to employ one or more dielectric filters in a duplexer arrangement in which the integral transmission line is used to reduce the length of external duplexing transmission lines.

Accordingly, these and other objects are realized in the present invention which encompasses a surface mountable dielectric block filter having at least two resonators extending from a first surface of the dielectric block to a second surface of the dielectric block. With the exception of the first surface, the dielectric block is substantially covered with a conductive material. An electrode is disposed on the first surface for coupling to one of the resonators. A transmission line, disposed on a surface of the dielectric block, couples the electrode to a terminal, disposed on a surface of the dielectric block, which directly connects to the conductive surface of the mounting substrate. Additionally, the terminals of two dielectric block filters may be connected to a transmitter leg transmission line and a receiver leg transmission line disposed on the substrate to be coupled to an antenna.

BRIEF DESCRIPTION OF THE DRAWINGS

FIG. 1 is a perspective view of a conventional dielectric block filter.

FIG. 2 is a cross section of the dielectric filter of FIG. 1.

FIG. 3 is a schematic diagram of the dielectric block filter of FIG. 1.

FIGS. 4A, 4B, and 4C are perspective views of dielectric block filters which employ the present invention.

FIG. 5 is a schematic diagram of the dielectric block filters of FIGS. 4A and 4B.

FIGS. 6A and 6B are perspective views of a dielectric block filter employing the present invention and illustrating a preferred mounting of the filter.

DESCRIPTION OF THE PREFERRED EMBODIMENT

Figure 7:
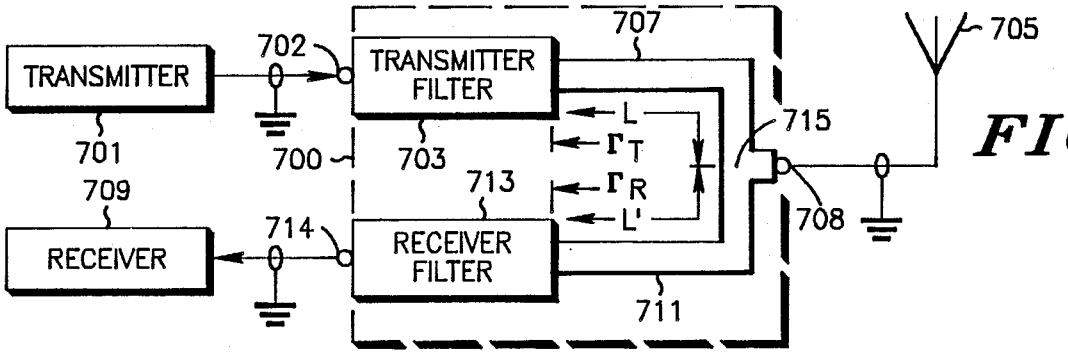
FIG. 7 is a schematic of a conventional radio duplexer.

FIG. 1 illustrates a conventional dielectric block filter 100 with a plurality of integral resonators. In order to realize the size reduction which may be accomplished by the use of a volume of dielectric material having a high dielectric constant in conjunction with low loss and low temperature coefficient, the dielectric material of such a dielectric block filter 100 is typically comprised of a ceramic compound such as a ceramic including barium oxide, titanium oxide, and/or zirconium oxide. Such a dielectric block 100 has previously been described in U.S. Pat. No. 4,431,977 (Sokola et al.).

The dielectric block filter 100 of FIG. 1 is typically covered or plated on most of its surfaces with an electrically conductive material, such as copper or silver. The top surface 103 is an exception and is described later. One or more holes in the dielectric material (105, 106, 107, 108, 109, 110, and 111 in FIG. 1) extend essentially parallel to each other from the top surface 103 of dielectric block filter 100 to the bottom surface. A cross-section of one of the holes is shown in FIG. 2.

In FIG. 2, a center resonating structure 201 is created by continuing the electrically conductive material 203, which is plated on the dielectric block 100, to the inner surface of the hole in the dielectric block 100. Additional size reduction and capacitive coupling from one resonator to another is achieved by continuing the plating from the inside of the hole onto a portion of the top surface 103, shown as resonator top surface plating 205.

Referring again to FIG. 1, it can be seen that seven metallized holes (105–111) form the foreshortened resonators of the dielectric block filter 100. Of course, the number of metallized holes (resonators) may vary depending upon the desired filter performance. The absolute number of resonators depicted in the present example should not be taken as a limitation of the present invention. As shown, capacitive coupling between each resonator is achieved across the gap in the top surface plating surrounding each resonator hole but other methods of inter-resonator coupling may alternatively be utilized without affecting the scope of the present invention. Tuning adjustments may be accomplished in conventional fashion by trimming appropriate sections of the metallized surface plating between resonators or between a resonator top surface plating and the electrically conductive material found on the sides and bottom of the dielectric block 100. It should be noted that the electrically conductive material found on the side and bottom surfaces of the dielectric block filter 100 (hereinafter called ground plating) may extend partly onto the top surface such as shown in the aforementioned U.S. Pat. No. 4,431,977 or may extend to a limited extent between the resonator top surface plating to control resonator to resonator coupling, as shown in U.S. Pat. No. 4,692,726 (Green et al.).

Coupling RF energy into and out of the dielectric block filter of FIG. 1 is typically accomplished by an electrode capacitively coupled to the resonator top surface plating of an end resonator. This is accomplished by capacitive electrode 113 for the input and capacitive electrode 115 for the output each disposed on the top surface 103 of dielectric block filter 100 of the present example. For proper operation at radio frequencies, input and output connections have generally been made employing coaxial transmission lines, as shown.

As shown in FIG. 1, the input capacitive electrode 113 is disposed between resonator hole 105 and resonator hole 106 and their associated top surface plating. This orientation allows the resonator 105 to be tuned as a transmission zero, that is, an equivalent short circuit at frequencies around the frequency at which the resonator 105 is resonant. Resonators 106 through 111 are utilized as transmission poles, that is, providing a bandpass of frequencies around the frequency to which each of the resonators 106–111 is tuned. Thus, it is possible to achieve an improved bandstop performance at a selected frequency outside the bandpass of the majority of the resonators of the filter. Such a configuration, however, need not be employed by the present invention and all resonators could be tuned as transmission poles.

An equivalent circuit for the dielectric block filter of FIG. 1 is shown in FIG. 3. Each resonator is shown as a length of transmission line ($Z_{105}$ through $Z_{111}$) and a shunt capacitor ($C_{105}$ through $C_{111}$) corresponding to the capacitance between the associated top surface plating and the ground plating. Top surface plating to top surface plating coupling is approximated by coupling capacitors C and the magnetic field coupling between resonators is approximated by transmission lines Z. The input electrode 113 effectively couples to the bandpass resonators through capacitor $C_x$, couples to the transmission zero resonator ($Z_{105}$) through capacitor $C_a$, and has a residual capacitance to ground $C_z$. The output electrode 115 couples to the resonator $Z_{111}$ through capacitor $C_x$ and has a residual capacitance to ground of $C_z$.

Since it is highly desirable that a dielectric block filter be directly mounted on a printed circuit board or other substrate, it is a feature of the present invention that the input and output capacitive electrodes 113 and 115 are connected to the substrate by way of an integral transmission line of a determined characteristic impedance and electrical length. Such a surface mount dielectric filter with an integral transmission line for input and output connections is shown in the perspective drawing of FIG. 4A. In a preferred embodiment of the present invention, the input capacitive electrode 113 is connected to external circuitry by way of a transmission line 401 plated on the top surface 103 of the dielectric block filter 100 and continuing onto a side surface upon which an interconnection terminal 403 is disposed. Similarly, a transmission line 405 couples output electrode 115 to an output interconnection terminal 407 on the side of dielectric block filter 100.

An alternative embodiment of the present invention is as shown in FIG. 4B. In this alternative, the input interconnection terminal 403' and the transmission line 401' as well as output interconnection terminal 407' and the associated transmission line 405' are disposed on the top surface 103 of the dielectric block filter 100. Both the input terminal 403' and the output terminal 407' are brought to the edge of dielectric block filter 100 so that direct connection may be made between the input/output terminals and a substrate when the dielectric block filter 100 is laid upon its side. Suitable amounts of the ground plating conductive material on side 409 are removed from the areas adjacent to the edge near input terminal 403' and output terminal 407'. In this way, the capacitance to ground is minimized and short circuiting is prevented.

Another alternative embodiment of the present invention is shown in FIG. 4C. If it is desired that the characteristic impedance of input transmission line be more closely maintained on the top surface 103 of dielectric block filter 100, the ground plating may be extended on either side of the transmission line 401 by top surface metalizations 411 and 413. Similar top surface metalizations may be utilized at the output transmission line, but are not shown in FIG. 4C. Rather, an output inductive coupling to the magnetic field of resonator 111 is shown. In this implementation, an interconnection terminal 415 is disposed on the side surface of dielectric block filter 100 and connected to an appropriate point (depending upon a desired output impedance) along transmission line 417 which is open circuited at one end and grounded to the ground plating at the other. The position and length of transmission line 417 is arranged such that optimal coupling to the magnetic field of resonator 111 is achieved. Similar coupling may be utilized for a filter input.

An equivalent circuit for the dielectric block filter of FIGS. 4A and 4B is shown in FIG. 5. The schematic representation shown in FIG. 5 is substantially identical to that shown in FIG. 3 except that transmission lines 401 and 405 are added to the input and output circuits, respectively. Several advantages accrue to this inventive improvement of dielectric filters. First, the utilization of one or more characteristic impedances of the length of transmission lines 401 and 405 may be employed to further match the input and output impedances of the dielectric filter to the circuitry connected to the input or output of the filter. Second, in those applications which require particular lengths of transmission line to achieve signal cancellation, a substantial portion of the transmission line may be included on the surface of the dielectric filter. Third, the coupling capacitance between the input/output capacitor electrodes can be maintained while realizing a low shunt capacitance to ground.

Figure 10:
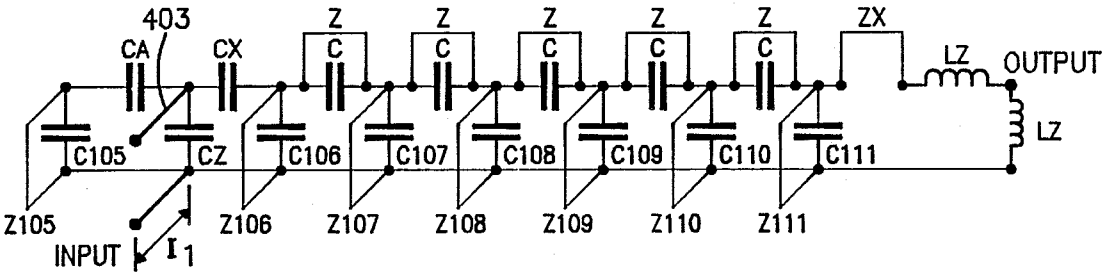
FIG. 10 is a schematic diagram of the dielectric block filter of FIG. 4C.

A schematic diagram showing the input and output coupling of the dielectric block filter 100 of FIG. 4C is shown in FIG. 10. The input circuit is modeled identically to that of FIG. 5. The output inductive coupling is modeled as a transmission line $Z_x$ and a split inductor ($L_x$, $L_z$) for impedance transformation.

In one implementation of the preferred embodiment, a bandpass filter centered at 888.5 MHz and having a bandwidth of 33 MHz was designed. The input and output impedance for this filter was 85 Ohms which required matching to a 50 Ohm source and a 50 Ohm load. In order to accomplish the impedance transformation, a quarter wavelength transmission line at 888.5 MHz having a characteristic impedance of 65 Ohms [$(Z_O2)=(50)(85)$]was metalized on the top and side surface of a filter such as that shown in FIG. 4A. The dielectric filter block 100 utilized a ceramic material having had a dielectric constant of 36 and an empirically determined effective dielectric constant of 9.4. To achieve the necessary impedance transformation, a transmission line length of 2.0mm and a line width of 0.25mm were designed.

In an implementation in which a 50 Ohm transmission line characteristic impedance is utilized to reduce the length of transmission line external to the block filter, a transmission line having a width of 0.56 mm and a length of 2.0mm may easily be implemented on a dielectric block filter such as that shown in FIG. 4A. In this instance a particular problem was noted in the construction of transmission lines 401 and 405. Typically, microstrip or stripline transmission line characteristic impedance may be easily calculated because of the geometric relationships of the conductive strip and its associated ground plane. Such symmetry is not necessarily present in the transmission line of the present invention. An effective ground plane had to be empirically determined. An additional complication was that a portion of transmission lines 401 and 405 were disposed on the top surface 103 of the dielectric block filter 100 and a portion of transmission lines 401 and 405 were mounted adjacent to a mounting substrate. Thus, the top surface portions had some electromagnetic field formed in an air dielectric while the side surface portions had some electromagnetic field formed in the dielectric of the mounting substrate. As a first approximation, however, when the dielectric constant of the dielectric block filter 100 equals 36, the dielectric constant of the substrate equals 4.5, and the dielectric constant of air equals 1, the difference between the dielectric constant of the mounting substrate and air is insubstantial relative to the dielectric constant of the block. For the transmission lines on the dielectric block filter 100 of the preferred embodiment, an effective dielectric constant of 9.4 over the transmission line length is used.

Mounting of the dielectric block filter 100 on a substrate is shown in FIGS. 6A and 6B. In FIG. 6A, the dielectric block filter 100 is pictured elevated over a mounting substrate 601. The mounting substrate 601 has a conductive surface 603 upon which the ground plating of dielectric block filter 100 is caused to be placed in electrical contact. An area of insulating material 605 is retained on substrate 601 to enable input mounting pad 607 and output mounting pad 609 to be electrically separate from the ground conductive area 603. Connected to the input pad 607, but disposed on the underside of substrate 601, is a transmission line conductor 611. Transmission line conductor 611 is coupled to external circuitry which may be coupled to the input of the filter. Likewise, output coupling pad 609 is connected to transmission line conductor 613 which, in turn, is coupled to circuitry at the output of the filter. Thus, dielectric block filter 100 is mounted on substrate 601 as shown in FIG. 6B.

As mentioned previously, some applications of a dielectric block filter place stringent requirements on input or output coupling performance. One such application is that of a radio transceiver duplexer as shown in FIG. 7. A conventionally operating duplexer filter 700 is coupled to a conventional transmitter 701 via an independent input port 702 to a transmitter filter 703 which, in turn, is coupled to an antenna 705 through a transmission line 707 having a length L and a common port 708. A conventional radio receiver 709 receives signals from the antenna 705 via the common port 708 and a transmission line 711 having length L' and coupled to the receiver filter 713. The output of the receiver filter 713 is coupled to the receiver 709 via independent output port 714. Since the transmitter 701 and the receiver 709 in applications such as in mobile and portable radiotelephone equipment must operate simultaneously, it is necessary that the high power signals from the transmitter 701 be decoupled from the generally weak signal to be received by the receiver 709. Typically, the transmitter 701 and the receiver 709 operate at frequencies which are separated from each other by a relatively small amount of frequency difference. It is therefore possible to build a transmitter filter 703 and a receiver filter 713 which have characteristics such that the transmitter filter 703 passes those frequencies which the transmitter 701 may generate while rejecting those frequencies which the receiver 709 may be tuned to receive. Likewise, the receiver filter 713 may be tuned to pass those frequencies which should be received by receiver 709 while rejecting those frequencies which may be transmitted by transmitter 701. Furthermore, the transmitter filter 703 may be designed to reject or block harmonics of the frequencies which are generated by the transmitter 701 so that these harmonic frequencies are not radiated by the antenna 105. Also, the receiver filter 713 may be designed to block frequencies which may be converted by a superheterodyne receiver into on-channel frequencies (image frequencies) and also block harmonics of the frequencies to which receiver 709 is normally tuned.

Good engineering design of the transmitter filter 703 and the receiver filter 713 produce filters having a reflection coefficient ($\Gamma$) which is as low as possible at the frequency to which the respective filter is tuned (indicative of an impedance match to the transmission lines 707 and 711 respectively). Thus, the $\Gamma_T$ of the transmitter filter 703 is designed to be near zero at the transmit frequency and some other, non-zero value at other frequencies such as the receive frequency. Similarly, the receiver filter $\Gamma_R$ is designed to be near zero at the receiver frequencies and some other nonzero value at other frequencies such as the transmit frequencies.

To advantageously use the non-zero reflection coefficient effectively, the length L of transmission line 707 is designed to be a quarter wavelength long at the receive frequencies and the length line 711, L', is designed to be a quarter wavelength long at the transmit frequencies. The quarter wavelength transmission line 707 and 711 transform the respective reflection coefficients (which are usually short circuits at the receive and transmit frequencies respectively) to near open circuits (at the respective, receive and transmit frequencies) at the duplex junction point 715 of the duplexer 700. In this way, receiver frequency energy from the antenna 705 which propagates along transmission line 707 is reflected from the transmitter filter 703 and combined in-phase with the receiver frequency energy propagating along transmission line 711, thus yielding a minimum insertion loss between the duplex point 715 and the receiver 709. Likewise, a reflection of transmitter energy which propagates along transmission line 711 from the receiver filter 713 combines in-phase at the duplex point 715 with the energy coming directly from the transmitter filter 703 to yield a minimum of insertion loss between the input of the transmitter filter 703 and the duplex point 715.

It can be seen, therefore, that if part or a majority of the transmission lines 707 and 711 could be placed on the surface of the dielectric filter block which forms the transmitter filter 703 and the filter block which forms the receiver filter 713 only a small portion of transmission line need be placed on the substrate upon which the filter blocks may be mounted. In a small transceiver, space is at a premium and a reduction of the physical size of duplexer transmission line offers the possibility of smaller size. Implementing the transmission lines on the filter block allows more area on the circuit board substrate for other components. Since the effective dielectric constant for the block-mounted transmission line is higher than for the circuit board substrate-mounted; transmission line, the block-mounted line will be both shorter and narrower than a substrate-mounted transmission line of the same electrical length.

Figure 8:
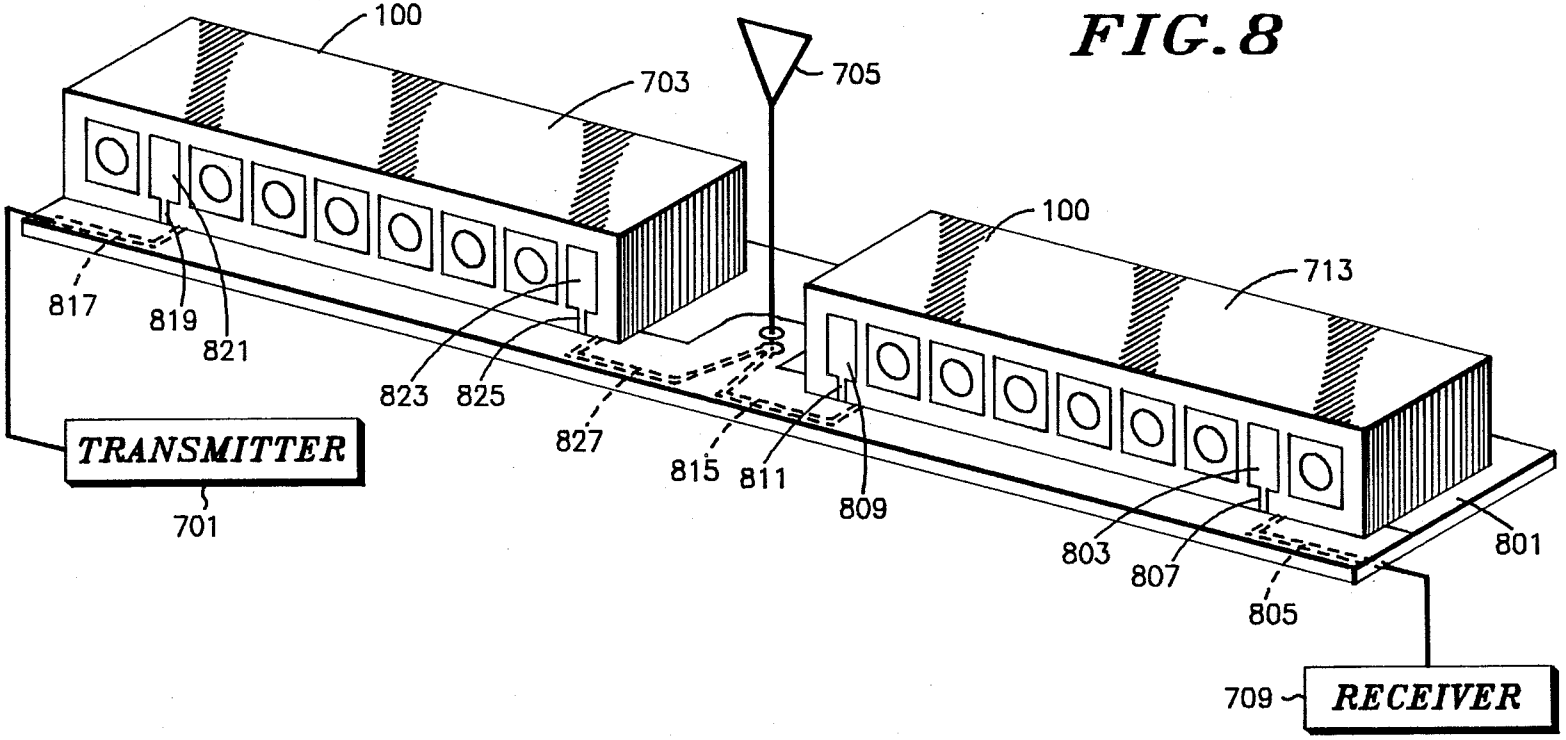
FIG. 8 is, in part, a perspective view of two dielectric block filters employing the present invention and coupled as a radio duplexer.

A mounting of two dielectric filter blocks on a single substrate 801 is shown in FIG. 8. In a preferred implementation, a receiver 709 may be coupled to the input capacitive electrode 803 by way of a transmission line 805 disposed on the underside of substrate 801 and connected to transmission line 807 which is disposed on one side and the top surface of the dielectric block filter 713. The output of the dielectric block filter 713 is coupled via capacitive electrode 809, integral transmission line 811 and transmission line 815 disposed on the underside of substrate 801 to the antenna 705. Similarly transmitter 701 is coupled to transmitter filter block 703 via transmission line 817 disposed on the underside of substrate 801, integral transmission line 819, and capacitive input electrode 821. Output from the transmitter block filter 703 is coupled via capacitive electrode 823 integral transmission line 825, and transmission line 827 disposed on the underside of substrate 801 to couple to antenna 705.

Figure 9:
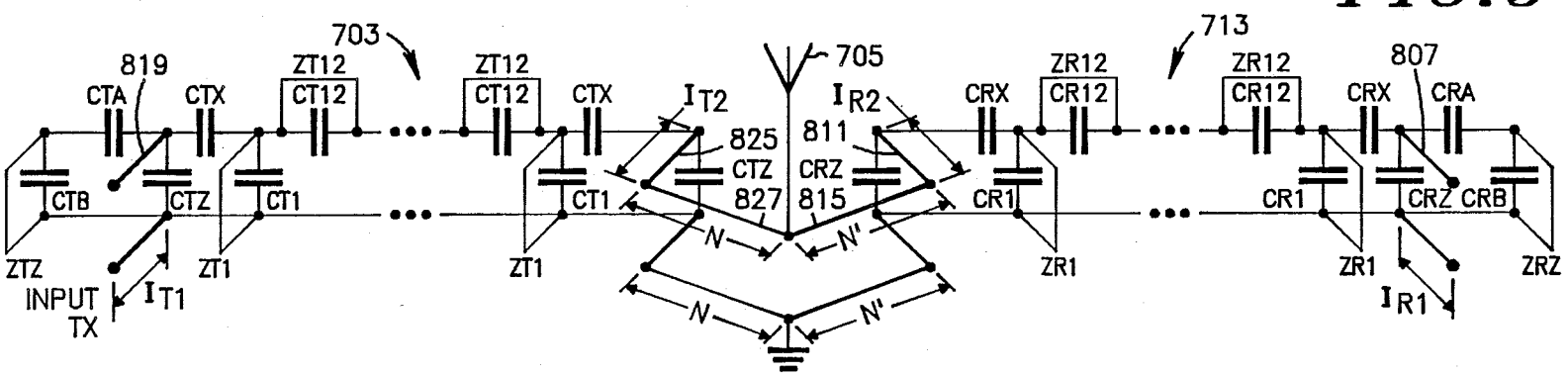
FIG. 9 is a schematic diagram of the duplexer of FIG. 8.

A schematic diagram of the duplexer filter of FIG. 8 is shown in FIG. 9. The transmission line coupling the receiver filter 713 to the antenna 705 is the combined electrical length of transmission line 811 and 815 ($I_{R2}$ and N'). The transmission line coupling the transmitter filter 703 to the antenna 705 is the combined length of transmission lines 825 and 827 ($I_{T2}$ and N). In one implementation of the preferred embodiment, the lengths in the receiver leg of the duplexer (L') are $I_{R2}$=2mm and N'=37.4mm. The lengths in the transmitter leg of the duplexer (L) are $I_{T2}$=2mm and N=65.3mm.

In summary, then, a surface mountable dielectric filter block employing integral input and output transmission lines has been shown and described. In order that stray capacitance between metallized input/output coupling capacitor and ground be reduced and improved matching be accomplished, a metallized transmission line is disposed between the input/output coupling capacitor and the output terminal. When the dielectric filter block is used as part of a duplexer, the input/output metallized transmission line comprises a significant portion of the duplex coupling lines. Therefore, while a particular embodiment of the invention has been shown and described, it should be understood that the invention is not limited thereto since modifications unrelated to the true spirit and scope of the invention may be made by those skilled in the art. It is therefore contemplated to cover the present invention and any and all such modifications by the claims of the present invention.

We claim:

1. A surface mountable dielectric block filter which directly mounts on a conductive surface of a substrate, comprising:

a volume of dielectric material having at least two conductive resonators within said volume of dielectric material and extending from a first surface of said volume of dielectric material to a second surface of said volume of dielectric material, said second surface and at least part of a third surface of said volume of dielectric material being substantially covered with a conductive material;

a first electrode disposed on said first surface of said volume of dielectric material for coupling to a first one of said at least two resonators;

a first terminal disposed on said third surface of said volume of dielectric material for directly connecting to the conductive surface of the substrate; and a first transmission line disposed on at least one surface of said volume of dielectric material, said first transmission line having first and second ends, coupled at said first end to said first electrode and coupled at said second end to said first terminal.

2. A surface mountable dielectric block filter in accordance with claim 1 wherein each of said at least two conductive resonators further comprises a conductive material substantially covering the surface of a hole extending from said first surface of said volume of dielectric material to said second surface of said volume of dielectric material.

3. A surface mountable dielectric block filter in accordance with claim 1 wherein said first one of said at least two resonators further comprises a second electrode disposed on said first surface of said volume of dielectric material.

4. A surface mountable dielectric block filter in accordance with claim 3 wherein said first electrode and said second electrode further comprise a capacitor.

5. A surface mountable dielectric block filter in accordance with claim 1 further comprising a third electrode disposed on said first surface of said volume of dielectric material for coupling to a second one of said at least two resonators.

6. A surface mountable dielectric block filter in accordance with claim 5 further comprising a second terminal disposed on said third surface of said volume of dielectric material for directly connecting to the conductive surface of the substrate.

7. A surface mountable dielectric block filter in accordance with claim 6 further comprising a second transmission line disposed on at least one surface of said volume of dielectric material, said second transmission line having first and second ends, coupled at said first end to said third electrode and coupled at said second end to said second terminal.

8. A surface mountable dielectric block filter in accordance with claim 1 wherein the conductive surface of the substrate further comprises a pattern which produces a substrate transmission line to which said first terminal is directly connected.

9. A surface mountable dielectric block filter in accordance with claim 1 wherein said conductive material covering at least part of said third surface of said volume of dielectric material is directly connected to the conductive surface of the substrate.

10. A surface mountable dielectric block filter which directly mounts on a conductive surface of a substrate, comprising:

a volume of dielectric material having at least two conductive resonators within said volume of dielectric material and extending from a first surface of said volume of dielectric material to a second surface of said dielectric material, all surfaces of said volume of dielectric material being substantially covered with a conductive material with the exception of said first surface;

a first electrode disposed on said first surface of said volume of dielectric material for coupling to a first one of said at least two resonators;

a first terminal of conductive material disposed on said first surface of said volume of dielectric material for directly connecting to the conductive surface of the substrate; and a first transmission line disposed on said first surface of said volume of dielectric material, said first transmission line having first and second ends, coupled at said first end to said first electrode and coupled at said second end to said first terminal.

11. A surface mountable dielectric block filter in accordance with claim 10 wherein each of said at least two conductive resonators further comprises a conductive material substantially covering the surface of a hole extending from said first surface of said volume of dielectric material to said second surface of said volume of dielectric material.

12. A surface mountable dielectric block filter in accordance with claim 10 wherein said first one of said at least two resonators further comprises a second electrode disposed on said first surface of said volume of dielectric material.

13. A surface mountable dielectric block filter in accordance with claim 12 wherein said first electrode and said second electrode further comprise a capacitor.

14. A surface mountable dielectric block filter in accordance with claim 10 further comprising a third electrode disposed on said first surface of said volume of dielectric material for coupling to a second one of said at least two resonators.

15. A surface mountable dielectric block filter in accordance with claim 14 further comprising a second terminal of conductive material disposed on said first surface of said volume of dielectric material for directly connecting to the conductive surface of the substrate.

16. A surface mountable dielectric block filter in accordance with claim 15 further comprising a second transmission line disposed on said first surface of said volume of dielectric material, said second transmission line having first and second ends, coupled at said first end to said third electrode and coupled at said second end to said second terminal 17. A surface mountable dielectric block filter in accordance with claim 10 wherein the conductive surface of the substrate further comprises a pattern which produces a substrate transmission line to which said first terminal is directly connected.

18. A surface mountable dielectric block filter in accordance with claim 10 wherein said conductive material substantially covering said surfaces of said volume of dielectric material is directly connected to the conductive surface of the substrate.

19. A surface mountable dielectric block filter which directly mounts on a conductive surface of a substrate, comprising:

a parallelepiped block of dielectric material having at least two resonators formed by two holes extending from a top surface of said parallelepiped block of dielectric material to a bottom surface of said parallelepiped block of dielectric material, said bottom surface and at least first, second, and third side surfaces of said parallelepiped block of dielectric material and surfaces of said at least two holes each being substantially covered with a conductive material;

a first electrode disposed on said top surface of said parallelepiped block of dielectric material for coupling to one of said at least two resonators;

a first terminal disposed on a fourth side surface of said parallelepiped block of dielectric material, for directly connecting to the conductive surface of the substrate; and a first transmission line disposed on said parallelepiped block of dielectric material, said first transmission line having first and second ends, coupled at said first end to said first electrode and coupled at said second end to said first terminal.

20. A surface mountable dielectric block filter in accordance with claim 19 wherein said first one of said at least two resonators further comprises a second electrode disposed on said first surface of said volume of dielectric material 21. A surface mountable dielectric block filter in accordance with claim 20 wherein said first electrode and said second electrode further comprise a capacitor.

22. A surface mountable dielectric block filter in accordance with claim 19 further comprising a third electrode disposed on said first surface of said volume of dielectric material for coupling to a second one of said at least two resonators.

23. A surface mountable dielectric block filter in accordance with claim 22 further comprising a second terminal disposed on said fourth side surface of said volume of dielectric material for directly connecting to the conductive surface of the substrate.

24. A surface mountable dielectric block filter in accordance with claim 23 further comprising a second transmission line disposed on said parallelpiped block of dielectric material, said second transmission line having first and second ends, coupled at said first end to said third electrode and coupled at said second end to said second terminal.

25. A surface mountable dielectric block filter in accordance with claim 19 wherein the conductive surface of the substrate further comprises a pattern which produces a substrate transmission line to which said first terminal is directly connected.

26. A surface mountable dielectric block filter in accordance with claim 19 wherein said conductive material covering at least part of said surfaces of said parallelpiped block of dielectric material is directly connected to the conductive surface of the substrate.

27. A surface mountable dielectric block filter which directly mounts on a conductive surface of a substrate, comprising:

a parallelepiped block of dielectric material having at least first and second resonators formed by two holes extending from a top surface of said parallelepiped block of dielectric material to a bottom surface of said parallelepiped block of dielectric material, said bottom surface and at least first second, and third side surfaces of said parallelepiped block of dielectric material and surfaces of said two holes each being substantially covered with a conductive material;

a first electrode disposed on said top surface of said parallelepiped block of dielectric material for coupling to said first resonator;

a second electrode disposed on said top surface of said parallelepiped block of dielectric material for coupling to said second resonator;

an input terminal disposed on a fourth side surface of said parallelepiped block of dielectric material, for directly connecting to the conductive surface of the substrate;

an output terminal disposed on said fourth side surface of said parallelepiped block of dielectric material, for directly connecting to the conductive surface of the substrate;

a first transmission line disposed on said parallelepiped block of dielectric material, said first transmission line having first and second ends, coupled at said first end to said first electrode and coupled at said second end to said input terminal; and a second transmission line having first and second ends, coupled at said first end to said second electrode and coupled at said second end to said output terminal.

28. A surface mountable dielectric block filter in accordance with claim 27 wherein at least one of said at least two resonators further comprises a third electrode disposed on said first surface of said volume of dielectric material.

29. A surface mountable dielectric block filter in accordance with claim 28 wherein said first electrode and said third electrode further comprise a capacitor.

30. A surface mountable dielectric block filter in accordance with claim 27 wherein the conductive surface of the substrate further comprises a pattern which produces a substrate transmission line to which said input terminal is directly connected.

31. A surface mountable dielectric block filter in accordance with claim 27 wherein the conductive surface of the substrate further comprises a pattern which produces a substrate transmission line to which said output terminal is directly connected.

32. A surface mountable dielectric block filter in accordance with claim 27 wherein said conductive material covering at least part of said surfaces of said parallelpiped block of dielectric material is directly connected to the conductive surface of the substrate.

33. A surface mountable dielectric block filter which directly mounts on a conductive surface of a substrate, comprising:

a parallelepiped block of dielectric material having at least two conductive resonators within said volume of dielectric material and extending from a top surface of said parallelepiped block of dielectric material to a bottom surface of said parallelepiped block of dielectric material, said bottom surface and at least first, second, and third side surfaces of said parallelepiped block of dielectric material each being substantially covered with a conductive material;

a first terminal, disposed on a fourth side surface of said parallelepiped block of dielectric material, for directly connecting to the conductive surface of the substrate; and a transmission line disposed on a fourth side surface of said parallelepiped block of dielectric material, said transmission line coupled to one of said at least two resonators and having first and second ends, said transmission line further coupled at said first end to said conductive material and coupled at least between said first end and said second end to said first terminal.

34. A surface mountable dielectric block filter in accordance with claim 33 wherein each of said at least two conductive resonators further comprises a conductive material substantially covering the surface of a hole extending from said top surface of said parallelepiped block of dielectric material to said bottom surface of said parallelepiped block of dielectric material.

35. A surface mountable dielectric block filter in accordance with claim 33 Wherein said first one of said at least two resonators further comprises a second electrode disposed on said top surface of said parallelepiped block of dielectric material.

36. A surface mountable dielectric block filter in accordance with claim 33 wherein the conductive surface of the substrate further comprises a pattern which produces a substrate transmission line to which said first terminal is directly connected.

37. A surface mountable dielectric block filter in accordance with claim 33 wherein said conductive material covering at least part of said surfaces of said parallelepiped block of dielectric material is directly connected to the conductive surface of the substrate

38. A radio transceiver duplexer comprising:

a substrate having a transmitter leg transmission line and a receiver leg transmission line disposed on said substrate for coupling a transmitter filter and a receiver filter to an antenna;

a first volume of dielectric material comprising:

(a)at least two conductive resonators tuned as a transmitter filter and disposed within said first volume of dielectric material and extending from a first surface of said first volume of dielectric material to a second surface of said first volume of dielectric material, said second surface and at least part of a third surface of said first volume of dielectric material being substantially covered with a conductive material, (b)a first electrode disposed on said first surface of said first volume of dielectric material for coupling to a first one of said at least two resonators, (c)a first terminal disposed on said third surface of said first volume of dielectric material for directly connecting to said transmitter leg transmission line, and (d)a first transmission line disposed on at least one surface of said first volume, said first transmission line having first and second ends, coupled at said first end to said first electrode and coupled at said second end to said first terminal; and a second volume of dielectric material comprising:

(a)at least two conductive resonators tuned as a receiver filter and disposed within said second volume of dielectric material extending from a first surface of said second volume of dielectric material to a second surface of said second volume of dielectric material, said second surface and at least part of a third surface of said second volume of dielectric material being substantially covered with a conductive material, (b)a first electrode disposed on said first surface of said second volume of dielectric material for coupling to a first one of said at least two resonators, (c)a first terminal disposed on said third surface of said second volume of dielectric material for directly connecting to said receiver leg transmission line, and (d)a second transmission line disposed on at least one surface of said second volume, said second transmission line having first and second ends, coupled at said first end to said first electrode and coupled at said second end to said first terminal.

39. A radio transceiver duplexer in accordance with claim 38 wherein each of said at least two conductive resonators in each of said volumes of dielectric material further comprises a conductive material substantially covering the surface of a hole extending from said first surface of each said volume of dielectric material to said second surface of each said volume of dielectric material.

40. A radio transceiver duplexer in accordance with claim 38 wherein at least one of said first and second volumes of dielectric material further comprises a second electrode of said first one of said at least two resonators disposed on said first surface of said at least one volume of dielectric material.

41. A radio transceiver duplexer in accordance with claim 40 wherein said first electrode and said second electrode further comprise a capacitor.

42. A radio transceiver duplexer comprising:

a substrate having a transmitter leg transmission line and a receiver leg transmission line disposed on said substrate for coupling a transmitter filter and a receiver filter to an antenna;

a first volume of dielectric material comprising:

(a)at least two conductive resonators tuned as a transmitter filter and disposed within said first volume of dielectric material and extending from a first surface of said first volume of dielectric material to a second surface of said first volume of dielectric material, all surfaces of said first volume of dielectric material being substantially covered with a conductive material, (b)a first electrode disposed on said first surface of said first volume of dielectric material for coupling to a first one of said at least two resonators, (c)a first terminal disposed on said first surface of said first volume of dielectric material for directly connecting to said transmitter leg transmission line, and (d)a first transmission line disposed on said first surface of said first volume, said first transmission line having first and second ends, coupled at said first end to said first electrode and coupled at said second end to said first terminal; and a second volume of dielectric material comprising:

(a)at least two resonators tuned as a receiver filter and disposed within said second volume of dielectric material and extending from a first surface of said second volume of dielectric material to a second surface of said second volume of dielectric material, all surfaces of said second volume of dielectric material being substantially covered with a conductive material, (b)a first electrode disposed on said first surface of said second volume of dielectric material for coupling to a first one of said at least two resonators, (c)a first terminal disposed on said first surface of said second volume of dielectric material for directly connecting to said receiver leg transmission line, and (d)a second transmission line disposed on said first surface of said second volume, said first transmission line having first and second ends, coupled at said first end to said first electrode and coupled at said second end to said first terminal.

43. A radio transceiver duplexer in accordance with claim 42 wherein each of said at least two conductive resonators in each of said volumes of dielectric material further comprises a conductive material substantially covering the surface of a hole extending from a first surface of each said volume of dielectric material to a second surface of each said volume of dielectric material.

44. A radio transceiver duplexer in accordance with claim 42 wherein at least one of said first and second volumes of dielectric material further comprises a second electrode of said first one of said at least two resonators disposed on said first surface of said at least one volume of dielectric material.

45. A radio transceiver duplexer in accordance with claim 42 wherein said first electrode and said second electrode further comprise a capacitor.

* * * * *